US005954245A

United States Patent [19]

Kluesner

[11] Patent Number: 5,954,245

[45] Date of Patent: Sep. 21, 1999

[54] NEEDLEWORK THIMBLE

[76] Inventor: Donna M. Kluesner, 21525 Heim Rd., New Vienna, Iowa 52065

[21] Appl. No.: 09/033,905

[22] Filed: Mar. 3, 1998

[51] Int. Cl.[6] ..... D05B 91/04

[52] U.S. Cl. ..... 223/101; 2/21; 602/22

[58] Field of Search ..... 223/101; 2/21; 602/22

[56] References Cited

U.S. PATENT DOCUMENTS

| | | | |
|---|---|---|---|
| 1,755,014 | 4/1930 | Morrison | 2/21 |
| 1,916,921 | 7/1933 | Dougan | 2/21 |
| 2,847,005 | 8/1958 | Bourne | 2/21 |
| 3,191,824 | 6/1965 | Burr | 223/101 |
| 5,765,731 | 6/1998 | Callian | 223/101 |

*Primary Examiner*—Bibhu Mohanty
*Attorney, Agent, or Firm*—Henderson & Sturm

[57] ABSTRACT

A needlework thimble comprising a shell to receive and encircle the finger of the user. The shell includes a pocket for receiving a supply of beeswax which lightly coats the thread during the sewing process to strengthen the thread and stabilize it against tangling and knotting. An elastic band is attached at an open end of the shell to secure the shell to the user's finger.

20 Claims, 2 Drawing Sheets

NEEDLEWORK THIMBLE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of hand sewing accessories, and more particularly to a needlework thimble.

2. Description of Related Art

As can be seen by reference to the following U.S. Pat. Nos. 44,045; 2,528,976; 2,536,979; 2,610,776; 4,643,341; and 4,944,437, the prior art is replete with myriad and diverse needlework accessories.

While all of the aforementioned prior art constructions are more than adequate for the basic purpose and function for which they have been specifically designed, they are uniformly deficient with respect to their failure to provide a simple, efficient, and practical construction to prevent the tangling and knotting of thread during the hand sewing process.

As a consequence of the foregoing situation, there has existed a longstanding need for a new and improved needlework thimble and the provision of such a construction is a stated objective of the present invention.

BRIEF SUMMARY OF THE INVENTION

Briefly stated, the present invention provides a needlework thimble comprising a shell to receive and encircle the finger of the user. The shell includes a pocket for receiving a supply of beeswax which lightly coats the thread during the sewing process to strengthen the thread and stabilize it against tangling and knotting. An elastic band is attached at an open end of the shell to secure the shell to the user's finger.

An object of the present invention is the provision of a sewing accessory that prevents tangling and knotting of thread during the sewing process.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
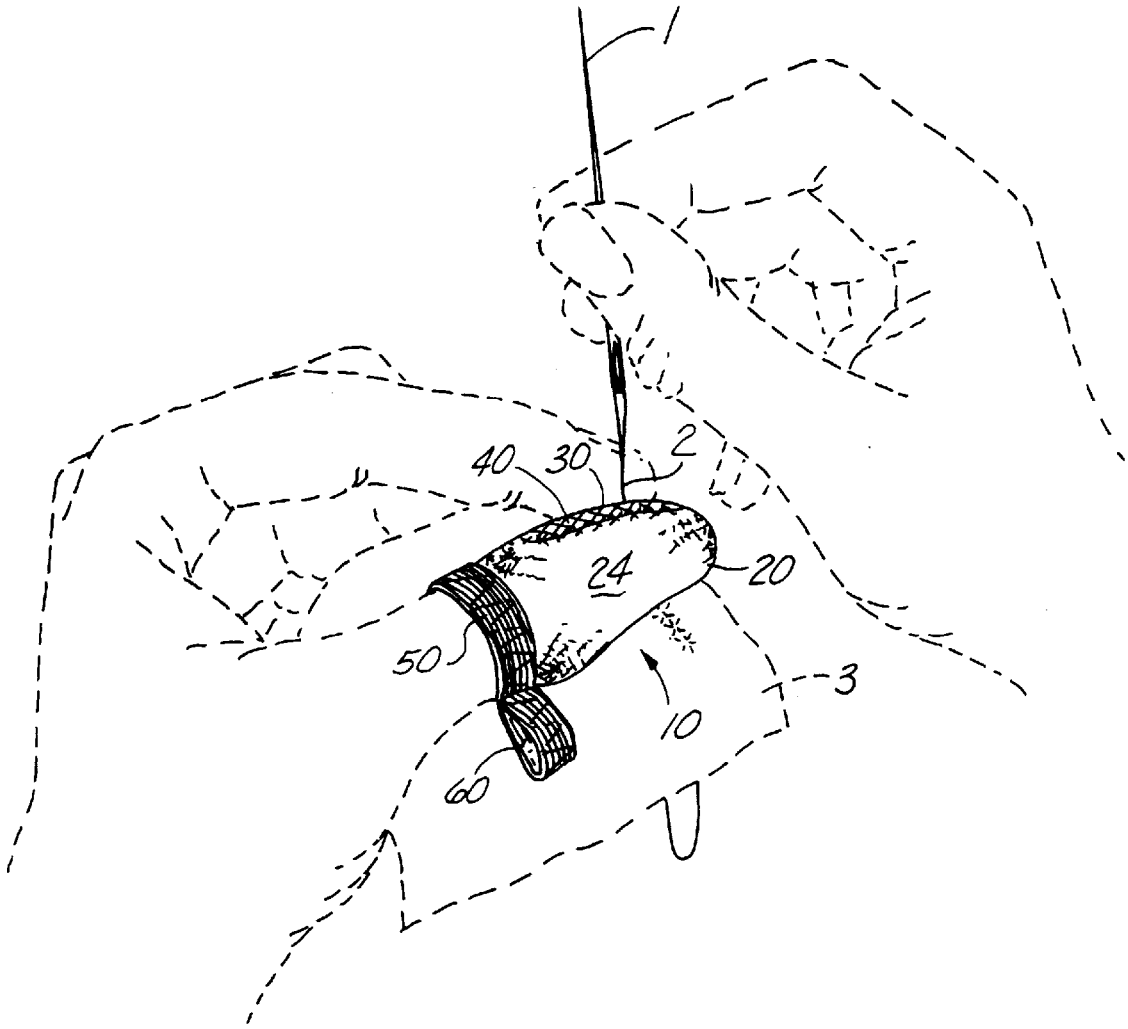
FIG. 1 is a perspective view showing the needlework thimble of the present invention secured to the thumb of the user.

As can be seen by reference to the drawings, and in particularly to FIG. 1, the needlework thimble that forms the basis of the present invention is designated generally by the reference number 10. The thimble 10 is shown secured to the left thumb of the user, while the user is manipulating the needle 1 and thread 2 with the right hand to sew on a workpiece 3. This will be the typical procedure for a right-handed individual. The thimble 10 would normally be used on the right thumb of a left-handed individual.

Figure 2:
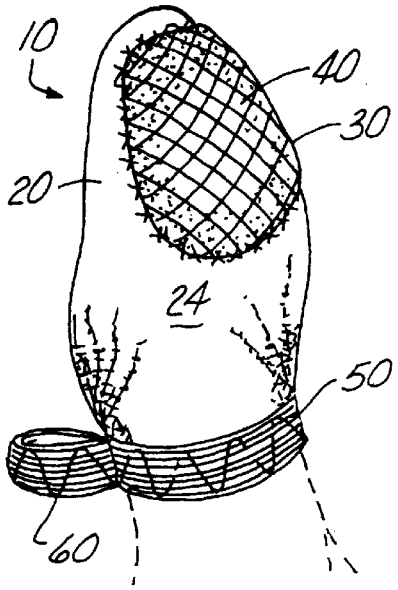
FIG. 2 is a perspective view of the thimble secured to the user's thumb with the beeswax positioned at the center of the interior thumb.
Figure 4:
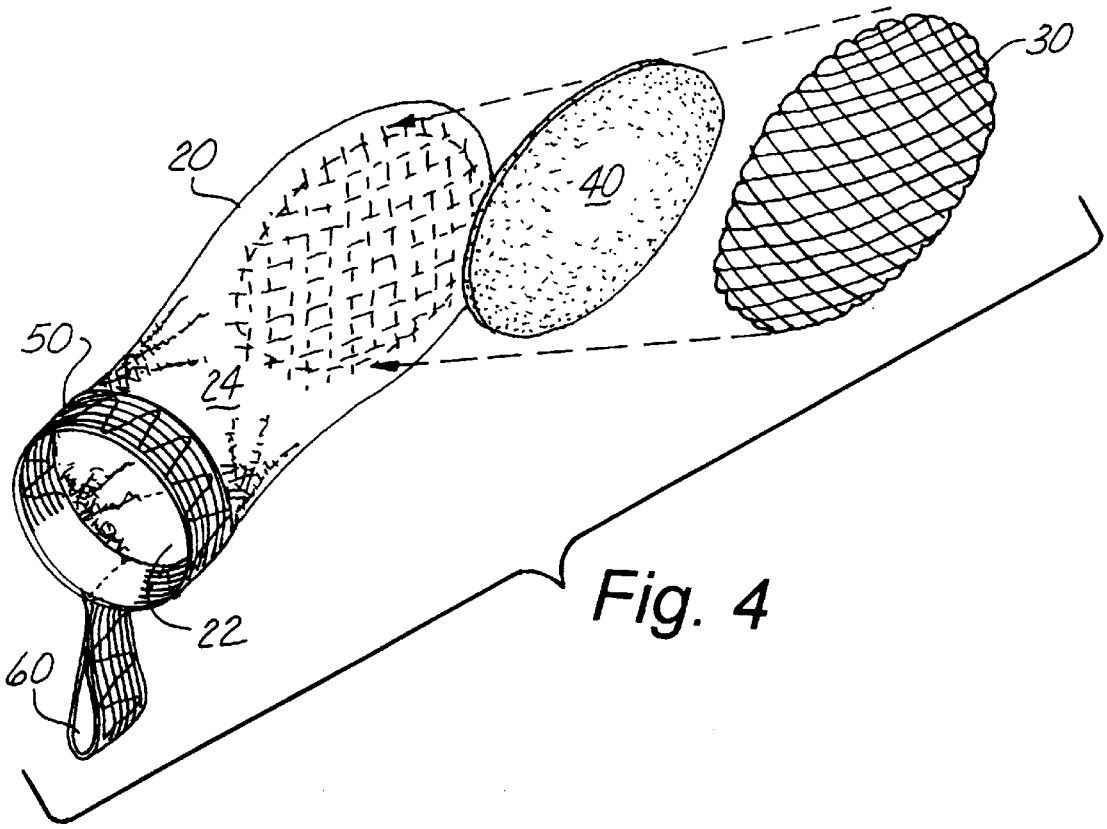
FIG. 4 is an exploded perspective view of the thimble illustrating the open mesh pocket that secures the beeswax to the shell.

As best shown in FIGS. 2 and 4, the thimble 10 includes a shell 20, a mesh pocket 30, a wafer of beeswax 40, an elastic band 50, and a loop 60.

The shell 20 has an open end 22 and sidewalls 24. The shell may be constructed of any suitable material including cotton, polyester, and a polyester-cotton blend. The pocket 30 is formed of an open weave or mesh netting material that is sewn to the shell 20 at a position that corresponds to the central interior thumb. The pocket 30 may be constructed of cotton, polyester, nylon, blends of these, and other suitable materials that may be of an open weave or crisscross pattern.

Figure 3:
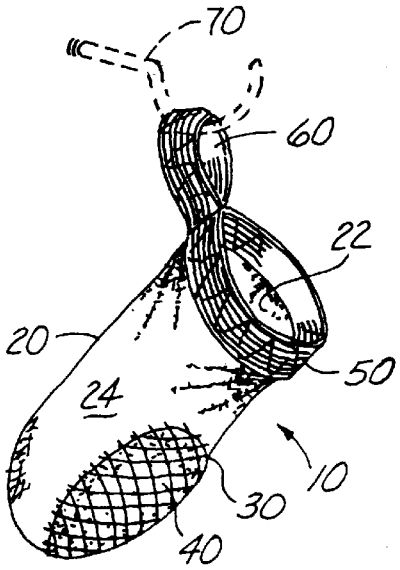
FIG. 3 is a perspective view of the thimble with the loop positioned over a hook for storage when not in use.

A wafer of wax material, preferably beeswax 40, is secured within the pocket 30 so that the wax surface is enmeshed in the material and is exposed to contact by the thread 2. An elastic band 50 is attached to the shell 20 at the open end 22. A loop 60 extends out from the shell 20, and may be used to engage a hook 70 for storage (FIG. 3).

In use, the thimble 10 is placed over the user's thumb as illustrated in FIGS. 1 and 2. The thread 2 is pulled between the thumb and the index finger and is lightly coated with beeswax 40 which strengthens the thread 2 and prevents tangling and knotting. In normal frequent use, the beeswax 40 is expected to last for several months.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A needlework thimble for use with a needle and thread in hand sewing, comprising:

a shell having an open end and lateral sides to receive and encircle a finger of a user;

a pocket formed on the lateral side of the shell; and a supply of a wax received within the pocket, the wax being disposed to contact the thread passing adjacent the finger of the user during a hand sewing step, whereby the thread is coated with wax to strengthen the thread and stabilize it against tangling and knotting.

2. The thimble of claim 1 wherein the shell is formed of pliable material.

3. The thimble of claim 2 wherein an elastic band is attached near the open end of the shell, whereby the shell is removably secured in position on the finger of the user.

4. The thimble of claim 3 wherein the elastic band includes a loop disposed outwardly from the shell.

5. The thimble of claim 1 wherein the pocket is formed of an open weave material.

6. The thimble of claim 2 wherein the pocket is formed of an open weave material.

7. The thimble of claim 3 wherein the pocket is formed of an open weave material.

8. The thimble of claim 4 wherein the pocket is formed of an open weave material.

9. The thimble of claim 1 wherein the wax is beeswax.

10. The thimble of claim 2 wherein the wax is beeswax.

11. The thimble of claim 3 wherein the wax is beeswax.

12. The thimble of claim 4 wherein the wax is beeswax.

13. The thimble of claim 5 wherein the wax is beeswax.

14. The thimble of claim 6 wherein the wax is beeswax.

15. The thimble of claim 7 wherein the wax is beeswax.

16. The thimble of claim 8 wherein the wax is beeswax.

17. The thimble of claim 1 wherein the shell includes a closed end.

18. The thimble of claim 2 wherein the shell includes a closed end.

19. The thimble of claim 5 wherein the shell includes a closed end.

20. The thimble of claim 9 wherein the shell includes a closed end.

* * * * *